US005349758A

United States Patent [19]

Bear

[11] Patent Number: 5,349,758

[45] Date of Patent: Sep. 27, 1994

[54] WOODWORKING SQUARE HAVING MULTIPLE USES

[76] Inventor: Michael Bear, #9 Carriage Ct., Beaufort, S.C. 29902

[21] Appl. No.: 967,792

[22] Filed: Oct. 28, 1992

[51] Int. Cl.[5] ..... B43L 7/027; B43L 7/033; B43L 7/02

[52] U.S. Cl. ..... 33/417; 33/429; 33/476; 33/481; 33/482; 33/194

[58] Field of Search ..... 33/416, 417, 429, 474, 33/476, 479, 480, 482, 194, 481

[56] References Cited

U.S. PATENT DOCUMENTS

| | | | |
|---|---|---|---|
| 313,197 | 3/1885 | Gaylord | 33/429 |
| 516,575 | 3/1894 | Parkhill . | |
| 1,196,519 | 8/1916 | Caylor | 33/476 |
| 1,255,429 | 2/1918 | Killion | 33/429 |
| 1,600,666 | 9/1926 | Dugan . | |
| 1,643,695 | 9/1927 | Bunler | 33/476 |
| 1,644,624 | 10/1927 | Andersen . | |
| 3,439,426 | 4/1969 | Wilson | 7/163 |
| 3,456,353 | 7/1969 | Iams | 33/429 |
| 4,355,471 | 10/1982 | Cross | 33/474 |
| 4,404,753 | 9/1983 | Klok | 33/474 |
| 4,513,510 | 4/1985 | Swanson . | |
| 4,598,482 | 7/1986 | Castleton . | |
| 4,742,619 | 5/1988 | Swanson | 33/494 |
| 5,090,129 | 2/1992 | Cunningham | 33/474 |
| 5,170,568 | 12/1992 | Wright | 33/474 |
| 5,239,762 | 8/1993 | Grizzell | 33/417 |

FOREIGN PATENT DOCUMENTS

| | | | |
|---|---|---|---|
| 2103378 | 2/1983 | United Kingdom | 33/474 |

*Primary Examiner*—Thomas B. Will
*Attorney, Agent, or Firm*—Jones & Askew

[57] ABSTRACT

A woodworking square having multiple uses. The square may be used to locate long and short points for trimming an opening and may be used to locate pitch line for rafters in a quick, efficient manner. The device also serves as a arc or circle drawing instrument. The device includes ledges so that it may slide against a straight edge and perform a cut or draw a line parallel to the straight edge.

19 Claims, 7 Drawing Sheets

10
12
14
16
18
20
22
24
26
27
28
30
31
32
34
38
41
42
44
48
49
2
3
4

82
198
95
90
80
10
97
26
87
94
86
46
84
88
92

WOODWORKING SQUARE HAVING MULTIPLE USES

FIELD OF THE INVENTION

This invention relates in general to woodworking tools and more particularly relates to a woodworking square having multiple uses.

BACKGROUND OF THE INVENTION

Formation of the rafters and support members for a common pitched roof requires marking rafters at different angles so they can be cut correctly to fit the roof structure. Marks must be made for pitch lines, bird's mouth cuts, notches for ledgers, and other cuts to be made. There are many examples in the prior art of devices to simplify the steps of marking and cutting these rafters and many devices which are capable of more than one or two of the functions required to mark the rafters properly. Examples of such devices can be found in U.S. Pat. Nos. 1,644,624, 4,513,510, 4,598,482, and 5,090,129.

Traditionally, a carpenter cuts out the rafters for a structure using a framing square, a carpenter's tape, a look-up table for the desired pitch from any of several available rafter books, and the zero pitch roof plan from which the run of each rafter is given or can be obtained by measuring the drawing. Although this method can achieve accurate results, it is time consuming and requires a good deal of manipulation of the framing square and addition of the table entries. Each additional step provides another possibility for error. As is explained in U.S. Pat. No. 4,598,482, templates have been created which can replace the framing square. These templates may have a fixed angle that is the desired degree of pitch and therefore does not require continuous manipulation by the user. However, use of such devices may require several templates for different degrees of pitch or may require various adjustments to obtain different pitches. There is a need in the field of rafter marking tools for a device which is easily manipulated to mark the pitch line for a variety of different pitches. Similarly, there is a need for a device which can quickly mark bird's mouth cuts and notches for ledgers.

In construction of a house, a worker will find it necessary to cut or strip sheet rock or other construction materials along a line parallel to one side of the material. In the past, these cuts were made by first measuring twice from the side or straight edge and drawing a line between the two measurements. A cut was then made along the line with a utility knife. This two-stepped method is time-consuming for a worker. Moreover, cutting along a line without a guide may result in uneven lines. There is a need for a better device for cutting the construction material along the line parallel to an edge.

To trim any opening correctly, a carpenter must measure the short and long points for the trim at various intervals along each side of the opening. Lines must be drawn then to connect these measurements. The lines represent the margins for the eventual trim for the opening. This method is slow and invites possible errors if incorrect markings are made. There is a need for a quicker, more accurate means of marking the margins for trim for openings.

Modem architecture has added many arcs in doorways and windows which require drawing of any number of different size arcs before making a cut. Generally, the arcs are drawn by the use of a string, a nail, and a pencil. The nail is driven into the center point of the arc of the circle and the string is extended between the pencil and the nail. The length of the string between the nail and pencil is equal to the radius of the arc. Thus, when the string is taut, the pencil encircles the nail and draws an arc. This method of drawing arcs is slow and may be inaccurate because different angles of the pencil may give different radii, and keeping the string taut while drawing the arc may be difficult. There is a need for a quicker, simpler, and more efficient way of marking the arcs.

SUMMARY OF THE INVENTION

The present invention solves the above-mentioned problems by providing a woodworking tool that can perform a variety of different functions quickly and efficiently. The tool can be used for framing, marking, cutting, roof framing, and many other uses. With the proper selection of materials, a lightweight, versatile, and helpful tool can be fabricated.

More specifically stated, the present invention provides a device for use in laying out pitch angles on a rafter including a straight edge thereon, the device including an elongate body member defining an axis therethrough with a pivot surface located on the axis. At least one wing member is located coplanar with the elongate body member and includes a scale thereon, with the scale comprising a plurality of spaced-apart marks each of which corresponds to an angle. The device is configured such that when the pivot surface is positioned adjacent the straight edge of the rafter, one of the plurality of marks of the scale corresponds with the straight edge of the rafter, and the angle corresponds to the one of plurality of scales indicating the angle formed between the elongate body member and the straight edge of the rafter. The square preferably comprises two wings, each comprising a scale such that measurements can be made from both sides of the elongate body member. Preferably, two legs defining top sides and bottom sides thereon extend from a juncture on the elongate body member and form a Y configuration with the elongate body member. The legs form a fight angle with each other, and each leg forms a 135° angle with the elongate planar body member. The wings extend inwardly and angularly from the ends of the legs opposite this juncture.

Preferably, the pivot surface is formed by two ledges extending under the bottom of the legs and along the legs, the ledges meeting at the juncture to form the pivot surface. The elongate member may include a scale extending up its length such that when one of the ledges extends along the side of the straight edge of the rafter and the wings and the elongate member lay against the rafter, the scale and the elongate planar body member are at 45° to the straight edge and the scale reads a perpendicular distance from the straight edge. Holes may extend up the elongate planar body member at lengths corresponding to the lines on the scale and for receiving a writing instrument for marking on the rafter. In addition, a blade guide may be included such that cuts may be made parallel to the straight edge. The elongate member may include a circumference marker along its length such that arcs and circles may be drawn using the pivot surface as a central point.

Another embodiment of the present invention provides a device for cutting a surface parallel to a straight edge located at the edge of the surface, the device comprising an elongate member defining a leading end and a trailing end thereon and a plane therethrough. A first elongate ledge extends perpendicular to the plane and is formed so as to abut the straight edge when the elongate member is against the surface. A means for associating a blade with the elongate member is provided such that movement of the device along the straight edge causes the blade to make a cut parallel to the straight edge. The elongate ledge and elongate member may be joined at an obtuse angle so that cutting may be performed at an area on the surface extending past the ledge but still parallel to the straight edge. A scale may be provided so that the user may know the perpendicular distance from the straight edge. In addition, holes may be provided along the elongate member such that a writing utensil may be used to draw lines parallel to the straight edge.

Therefore, it is an object of the present invention to provide an improved woodworking square.

It is another object of the present invention to provide a framing square having multiple uses.

Another object of the present invention is to provide a more efficient manner of marking bird's mouth cuts and notches for ledgers.

Still another object of the present invention is to provide a means for cutting a material parallel to a straight edge on the material.

Yet another object of the present invention is to provide a means for cutting a material parallel to a straight edge on the material to a point which extends past the straight edge.

Still another object of the present invention is to provide a means for marking short and long points for door framing along various intervals in an improved manner.

A further object of the present invention is to provide an improved means of marking a circumference of an arc or a circle.

Another object of the present invention is to provide an improved method of marking pitch on a rafter.

Other objects, features and advantages will become apparent upon consideration of the following detailed description of the invention when taken in conjunction with the drawing and the appended claims.

DETAILED DESCRIPTION OF THE INVENTION

Figure 1A:
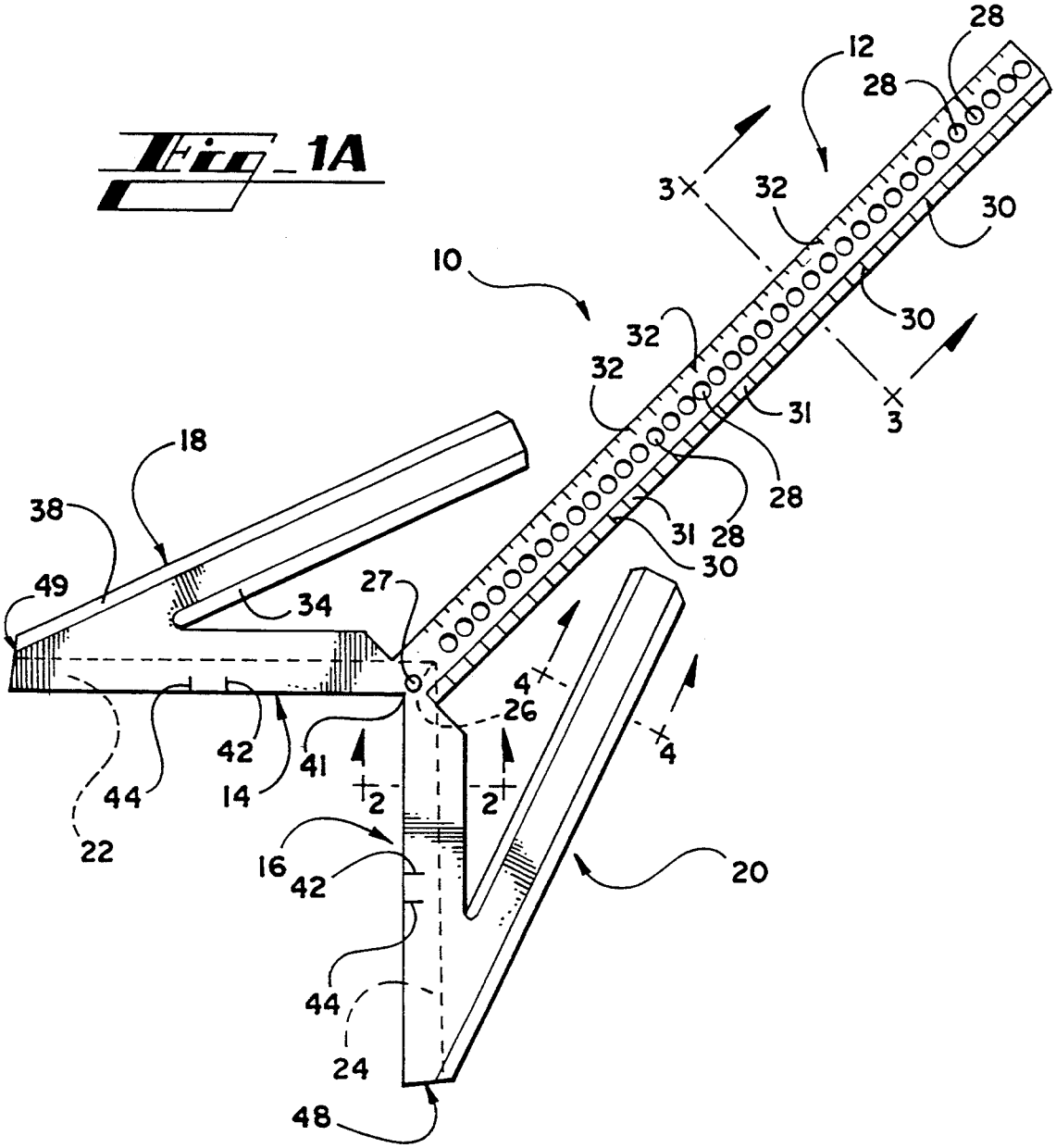
FIG. 1A is a pictorial view of a device embodying the present invention.
Figure 1B:
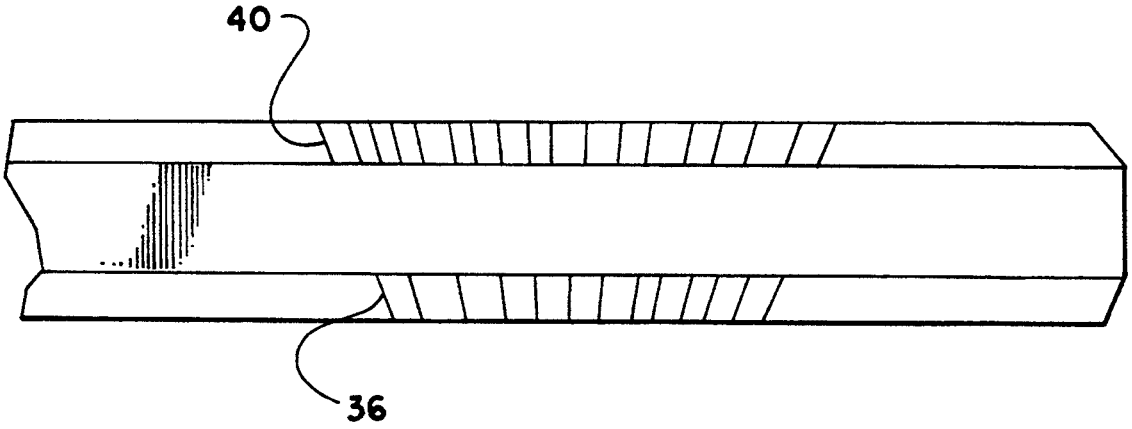
FIG. 1B is a pictorial view of one of the wings on the device of FIG. 1A.
Figure 2:
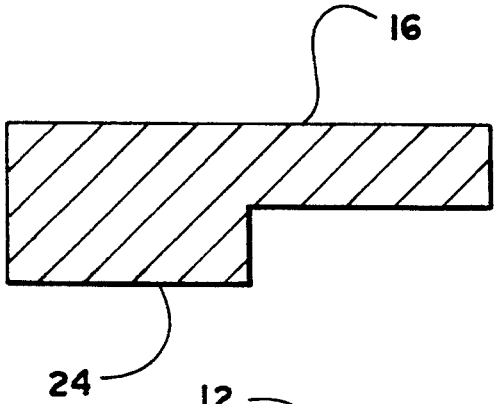
FIG. 2 is a cross-section of a leg and a ledge of the device shown in FIG. 1A taken along the section lines 2—2.
Figure 7:
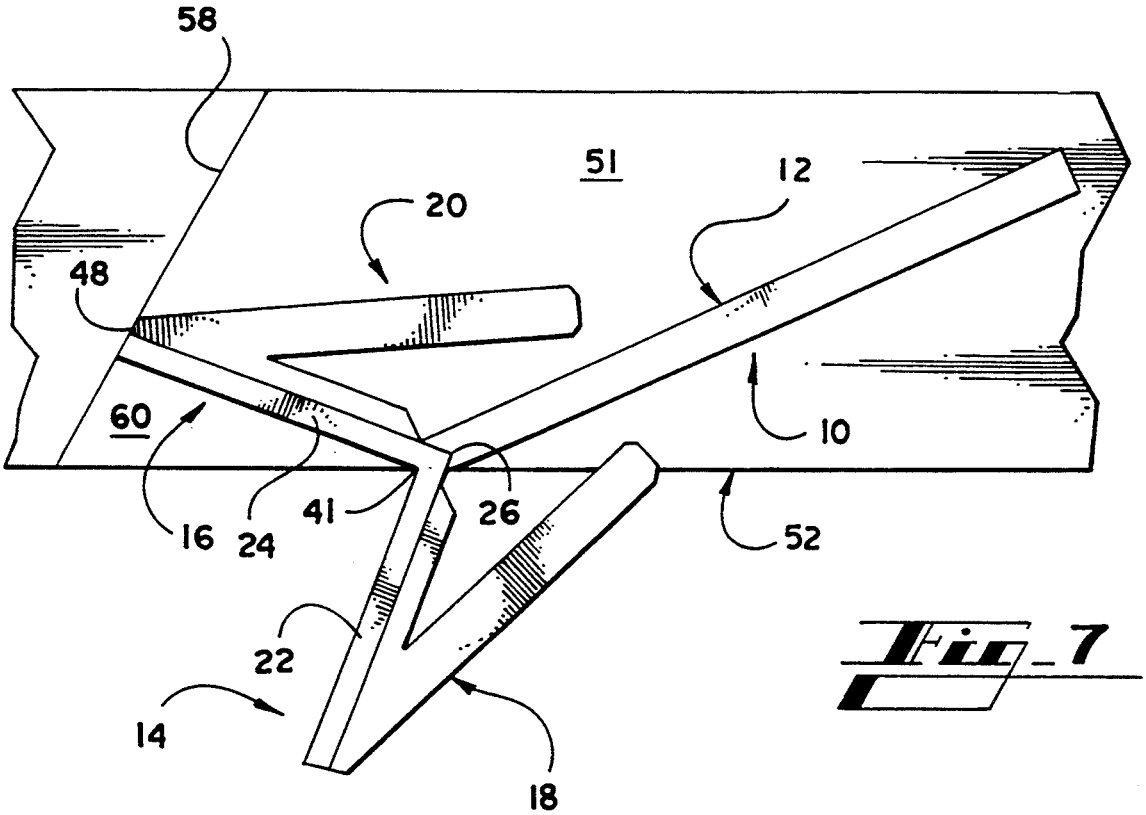
FIG. 7 shows the device of FIG. 1A used to locate a bird's mouth cut.

Turning now to the drawing, in which like reference numerals represent like parts through the several views, FIG. 1A shows a device 10 embodying the present invention. The device is preferably made of aluminum, but may be made of plastic, steel, or any other suitable material. The device includes an elongate portion 12 with two legs 14 and 16 extending angularly from a juncture at the end of the elongate member 12. The elongate member 12 and the two legs 14 and 16 form a "Y" configuration. Preferably, the two legs form a right angle and are each 135° from the elongate member. The device shown has two wing members 18 and 20 extending inwardly and angularly from the ends of the extended legs 14 and 16, respectively. The wings, the legs, and the elongate member are preferably coplanar and form a flat, planar piece which can lie substantially on the surface to be marked. As can best be seen by FIG. 2, ledges 22 and 24 extend underneath the legs 14 and 16, respectively. The ledges extend perpendicular to the plane of the legs 14 and 16, wings 18 and 20, and the elongate member 12. The ledges converge to form a right angle and a pivot surface at 26, as is shown in FIG. 1 and FIG. 7.

Figure 3:
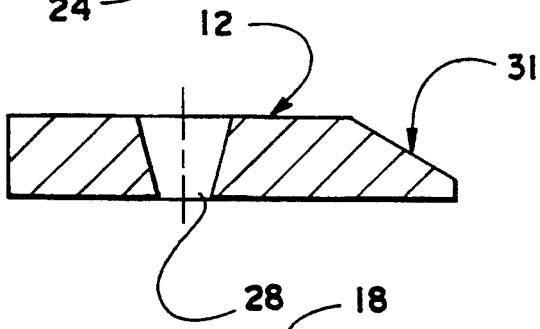
FIG. 3 is a cross-section of the elongate member of the device of FIG. 1A taken along the section lines 3—3.

A series of equidistantly-spaced holes 28 extend the length of the elongate member 12. Each of the series of holes 28 is a predetermined perpendicular distance from the line defined by the ledge 22. Since the angle formed by the first leg 14 and the elongate member 12 is the same as the angle formed by the second leg 16 and the elongate member 12, each of the series of holes 28 is also the same predetermined perpendicular distance from the line defined by the ledge 24. A scale 30 extends along the holes 28 to mark the perpendicular distance of each hole from the ledges 24 and 22. Therefore, the actual markings on the scale 30 are larger by a factor of the square root of two than the actual length of the elongate member 12 relative to the pivot surface 26. A pivot hole 27 for receiving a nail (not shown) extends through the juncture of the two ledges 22 and 24. As can best be seen by FIG. 3, the scale 30 is preferably on a sloped side 31 to provide easier reading. A scale 32 extends up the left side of the elongate member 12 which corresponds to the actual distance from the pivot hole 27. The use of the two scales 30 and 32 will be explained in detail below.

Figure 4:
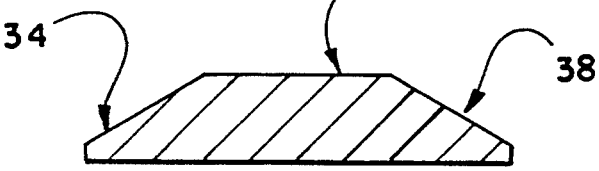
FIG. 4 is a cross-section of the wing member of the device of FIG. 1A taken along the section lines 4—4.

The wing members 18 and 20 are mirror images of each other. Therefore, only one of the wing members, wing member 18, will be described in detail. The side of the wing member closest to the pivot surface 26 has a sloped side 34, as is shown by FIG. 4, with a scale 36 extending along part of its length. The numbers on the scale 36 correspond to "common" pitch scale marks. The marks on the scale 36 do not extend perpendicularly to the edge of the wing member 18, but instead extend in a radial direction with respect to the pivot surface 26. Preferably, each of the pitch lines 0-12 to 12—12 are on this scale 36.

On the other side of the wing member 18 is a sloped side 38 on which is a scale 40. Like the scale 36, the scale 40 has marks which do not extend perpendicularly from the edge of the wing member 18 but instead extend in a radial direction with respect to the pivot surface 26. The scale 40 corresponds to "hip and valley" pitch scales and is preferably numbered from 0-12 to 17-12. The use of the scales 36 and 40 is described in detail below.

At the intersection of the ledges 22 and 24 is a juncture point 41 just opposite the pivot surface 26. Marks 42 and 44 are located on each of the legs 14 and 16 and correspond to 1½ and 1¾ inches from the juncture point 41. Preferably, these marks extend from the top side of the legs 14, 16 around to the bottom side of the ledges 22, 24. Each of the ends 48 and 49 of the legs 16 and 18 are preferably cut at right angles to the inner edges of the legs. To aid in sliding the device along a board, the inside edges of the right angle are beveled (not shown) at the ends 48 and 49.

Figure 5:
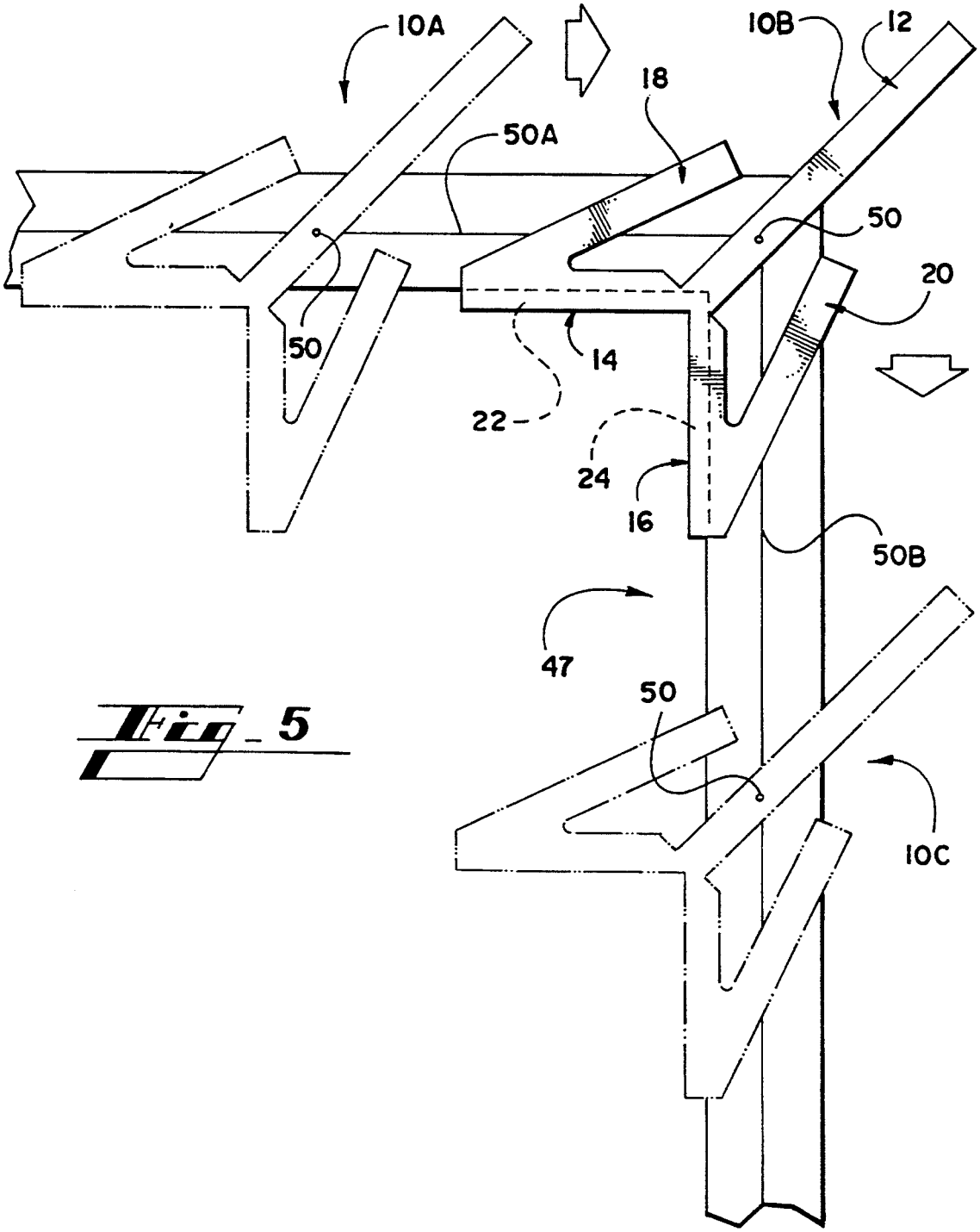
FIG. 5 shows use of the device of FIG. 1A to locate and draw long or short points per size casing for a door, or any opening to be trimmed.

The arrangement of the device 10 of the present invention allows it to have many uses and applications. The arrangement of the ledges 22 and 24 and the elongate member 12 allows the device 10 to locate the long point or short point per size casing at any point along the inside of an opening to be trimmed. In addition, the device allows a worker to continually mark the long or short point without lifting the device or changing its orientation. In FIG. 5, the device 10 is used to locate a continuous long point on a door frame 47. The long point is located at a perpendicular distance from the edge of the door frame which corresponds with the hole 50, so a pencil (not shown) is placed in that hole. The edge of the ledge 22 abuts the inside edge of the door frame to keep the hole 50 at an point equidistant at all times from the edge of the door frame 47. The device 10 first starts in the position marked 10*a*. The elongate member 12, the leg 14 and the wing member 18 each lie flat against the outer surface of the door frame.

With the device 10 oriented as is shown at 10*a*, the device may move from the left to the right to mark the upper right corner of the door frame shown in FIG. 5. Movement of the device from the position 10*a* to the right causes the line 50*a* to be drawn by the pencil and causes the device to be moved to the location of the device corresponding to 10*b* at the corner of the door frame. The ledge 24 now abuts the inside of the door frame. Because of the configuration of the device, the point 50 on the device extends past the inside edge of the door to a point at the beginning of the line 50*b*. The device is then moved downward to the location of the device at 10*c* while the pencil draws the line 50*b*. In this manner, the long and short points per size casing can be drawn continuously and accurately without lifting the device 10. It can be seen that the advantageous obtuse angles formed between the ledges and the elongate member (here, each is 135°) allow the pencil and the device to draw lines parallel to the door frame but past the inside edge of the door frame. Also, the arrangement of the device 10 allows the device to be pivoted without turning the device over so that margins for the upper left comer of the door frame or other openings to be marked may be drawn.

Figure 6:
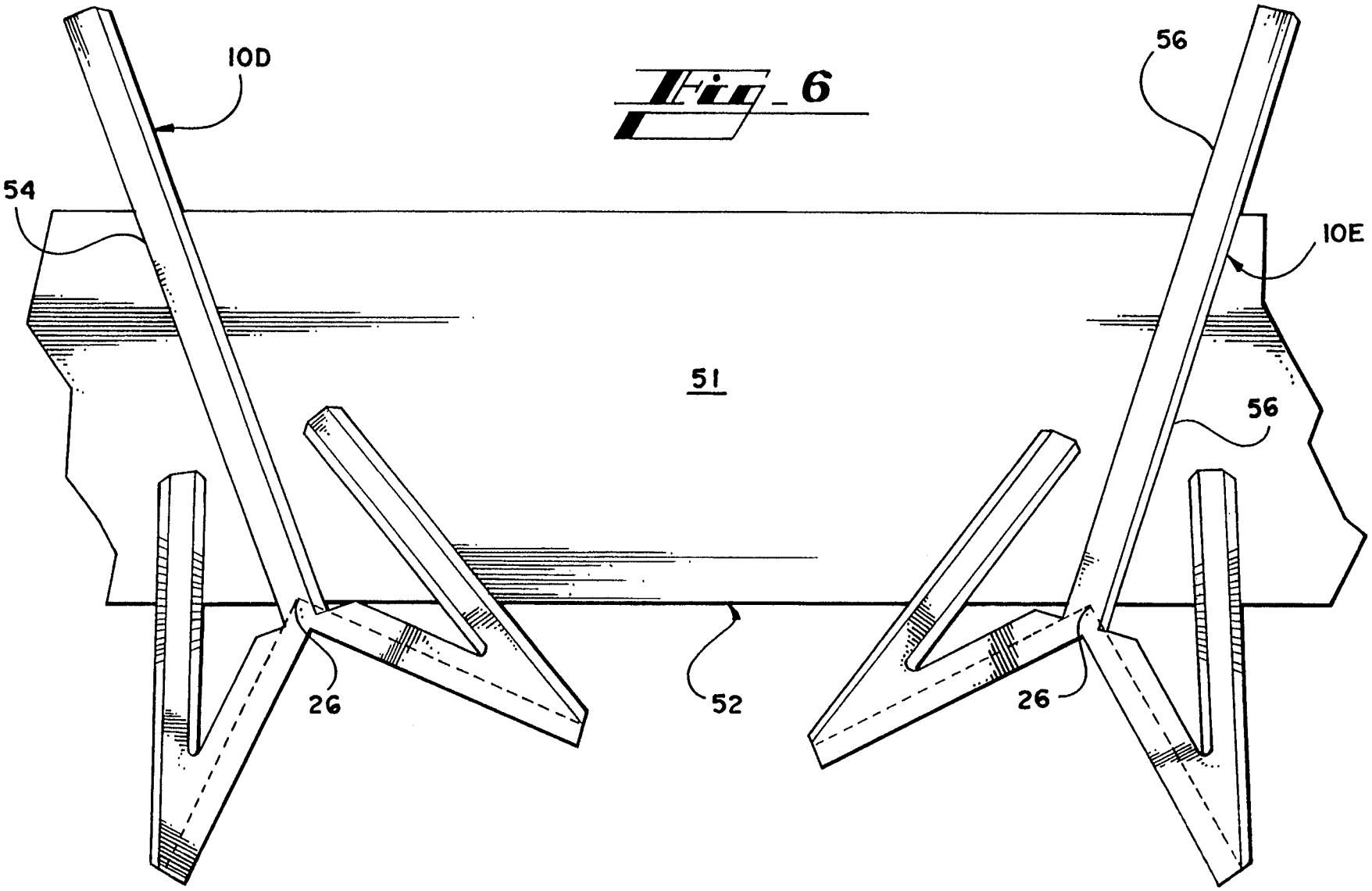
FIG. 6 shows the device of FIG. 1A used to locate pitch lines.

A second function of the device 10 is shown in FIG. 6. In FIG. 6 the device 10 is used to locate short-cut pitch lines from a 0-12 pitch to a 12-12 pitch on the common scale and to locate a 0-12 to 17-12 pitch on a hip-and-valley scale. The initial mark 0-12 on the common scale corresponds to 0° with a line extending perpendicular from the elongate member 12 from the pivot surface 26 ("reference line"). Thus, if the pivot surface 26 abuts one edge 52 of a rafter 51 to be marked and the 0-12 mark is aligned with the same edge 52 of the rafter, the elongate member 12 will extend at an angle of 90° to the rafter. A cut made along this line would correspond to a cut needed for a 0-12 pitch roof rafter.

The rest of the marks on the scale 36 will, when aligned with the edge of the rafter while the pivot surface abuts the edge, cause the elongate member to extend to the appropriate pitch angle. The angles between the reference line and the lines extending from the pivot surface to the corresponding marks on the scale are as follows:

| Common Pitch | Angle in Degrees |
|---|---|
| 1-12 | 4.76 |
| 2-12 | 9.46 |
| 3-12 | 14.04 |
| 4-12 | 18.43 |
| 5-12 | 22.62 |
| 6-12 | 26.57 |
| 7-12 | 30.26 |
| 8-12 | 33.69 |
| 9-12 | 36.87 |
| 10-12 | 39.81 |
| 11-12 | 42.51 |
| 12-12 | 45.00 |

Similarly, the outer scale 40 contains 18 marks corresponding to the hip-and-valley scale starting at 0-12 and going to 17-12. Again, as in the common scale, the 0-12 pitch mark corresponds to 0°. Using the same reference as in the common scale, the rest of the marks are the listed angle from the reference line:

| Hip and Valley Pitch | Angle in Degrees |
|---|---|
| 1-12 | 3.37 |
| 2-12 | 6.72 |
| 3-12 | 10.02 |
| 4-12 | 13.26 |
| 5-12 | 16.42 |
| 6-12 | 19.47 |
| 7-12 | 22.42 |
| 8-12 | 25.24 |
| 9-12 | 27.94 |
| 10-12 | 30.51 |
| 11-12 | 32.95 |
| 12-12 | 35.26 |
| 13-12 | 37.45 |
| 14-12 | 39.52 |
| 15-12 | 41.47 |
| 16-12 | 43.31 |
| 17-12 | 45.05 |

By aligning the proper pitch mark on one of the scales 36 or 40 with the edge of the rafter 51 and abutting the pivot surface 26 against the edge 52 of the rafter 51, pitch lines may be located on the rafter 51 and may be drawn along the elongate member 12. As is shown in FIG. 6, the device 10 may locate the pitch lines by pivoting right to left without changing to the opposite side of the board. The device 10*d* on the left is shown locating the short-cut pitch line 54 and the device 10*e* on the right side of FIG. 6 is shown locating the short-cut pitch line 56. If several short-cut lines having the same pitch need to be marked, a locking device (not shown) may be used to hold the device 10 at a certain pitch angle. Such a locking device is sold by General Tool Manufacturing Company, New York, N.Y. as a "Stair Gauge Set", Tool #803. The locking device simply slides over the end of one of the wing members 18 or 20. The locking device is then locked into position on the wing at the proper place such that abutting the locking device and the pivot surface against the edge of the board causes the device 10 to align on the preselected pitch angle.

Turning now to FIG. 7, the device 10 is flipped over and is used to locate a bird's mouth cut 60. Once a pitch line 58 is marked, the flat end 48 of the leg 16 is aligned against the pitch line 58 and the device 10 is moved up and down the pitch line until the juncture point 41 is located on the edge 52 of the rafter 51. The length of the leg 16 is preferably 3½ inches long to form the proper bird's mouth cut. The bird's mouth cut 60 is the area between the edge 52 of the rafter 51, the leg 16, and the pitch line 58. Once the device 10 is in the proper position, the line extending parallel to the leg 16 may be marked and the bird's mouth is ready to be cut.

Figure 8:
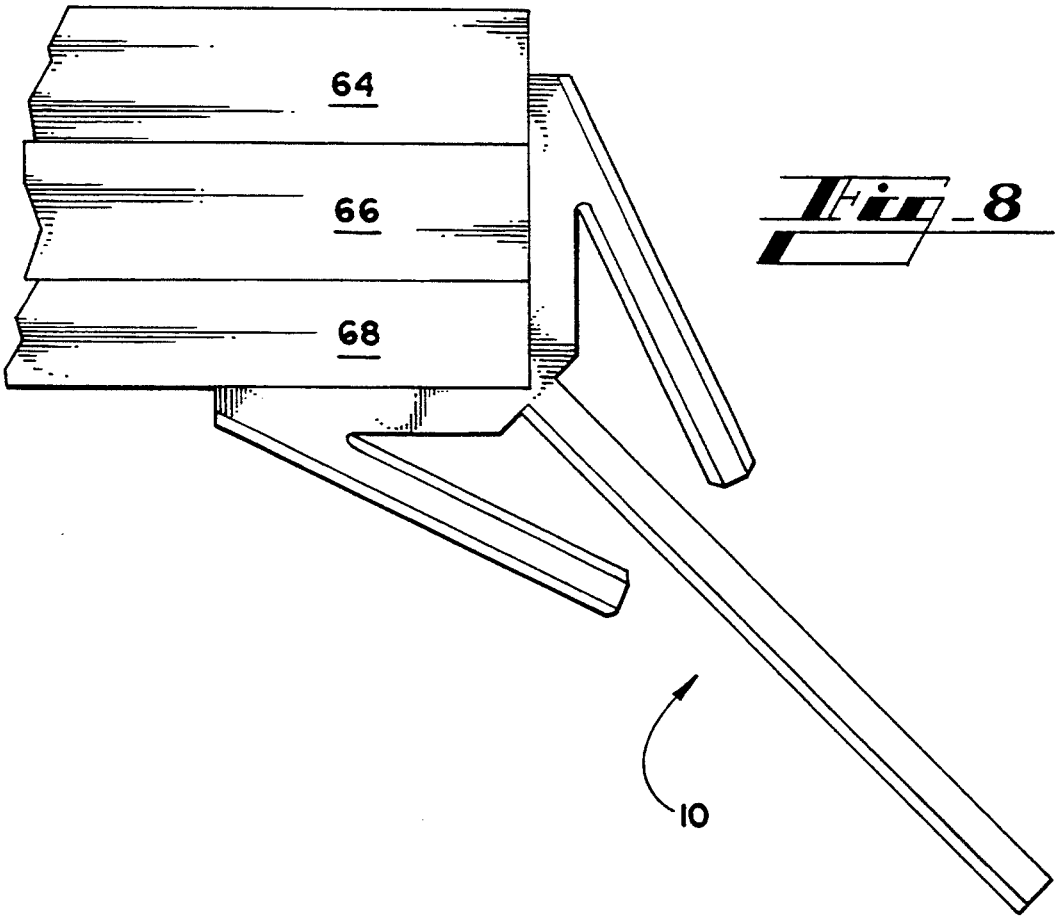
FIG. 8 shows the device of FIG. 1A used as a flush gauge.

Referring now to FIG. 8, the device 10 serves as a flush gauge to keep the ends of lumber plumb when nailing the pieces of lumber together. In FIG. 6, the three pieces of lumber 64, 66 and 68 are held flush at the right end by the application of pressure through the device. Thus, the three pieces of lumber may be nailed and will remain plumb at the end as long as the device remains snugly against the end of the three pieces of lumber.

Figure 9:
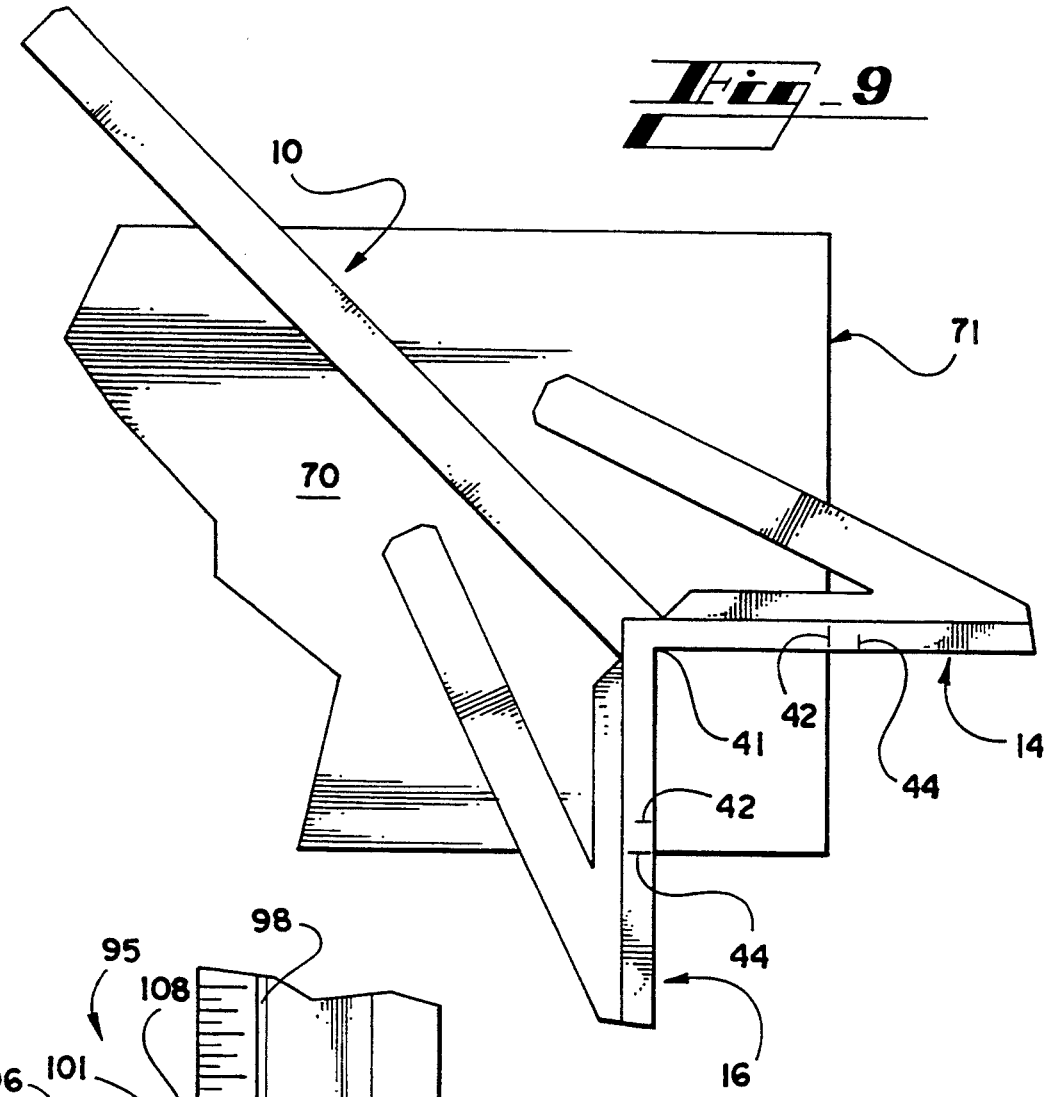
FIG. 9 shows the device of FIG. 1A used to mark notches for a ledger strip.

Still another function of the device 10 is shown in FIG. 9. A board 70 is shown which includes an end 71 to be marked for a ledger. The device 10 is flipped upside down and the mark 42 on the leg 14 (corresponding to 1½ inches from juncture 41) and the mark 44 on the leg 16 (corresponding to 1¾ inches from juncture 41) are aligned against the end 71 Of the board and the bottom edge of the board, respectively. Lines are then drawn against the inside of the legs 14 and 16 and the notch is marked for the ledger strip.

The device 10 may mark lines parallel to a straight edge on a board or other materials by using the device in a manner similar to the method described with FIG. 5. Thus, a marking instrument may be inserted in any of the holes along the length of the elongate member 12 and the device may move down the surface to be drawn on with one of the ledges 22 or 24 abutting the straight edge of the material to be marked. Since the writing instrument is held a constant distance from the straight edge, a line parallel to the straight edge will be drawn.

Figure 11:
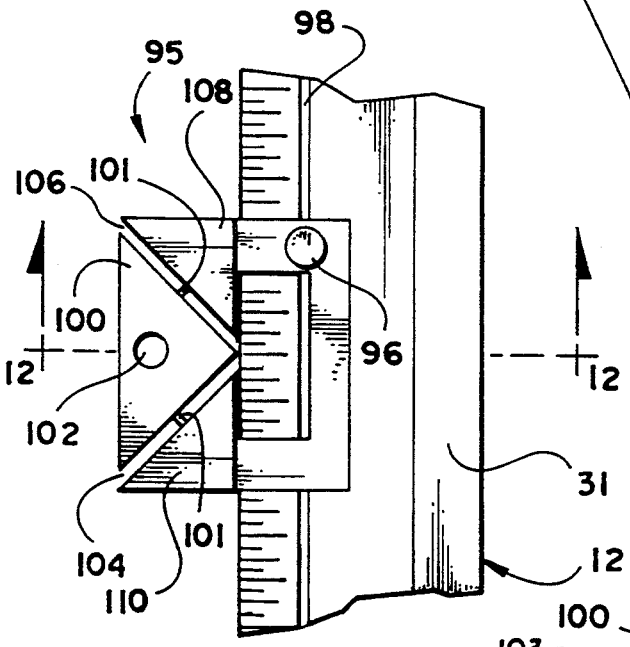
FIG. 11 is a pictorial view of a knife blade guide for use with the device of the present invention.
Figure 12:
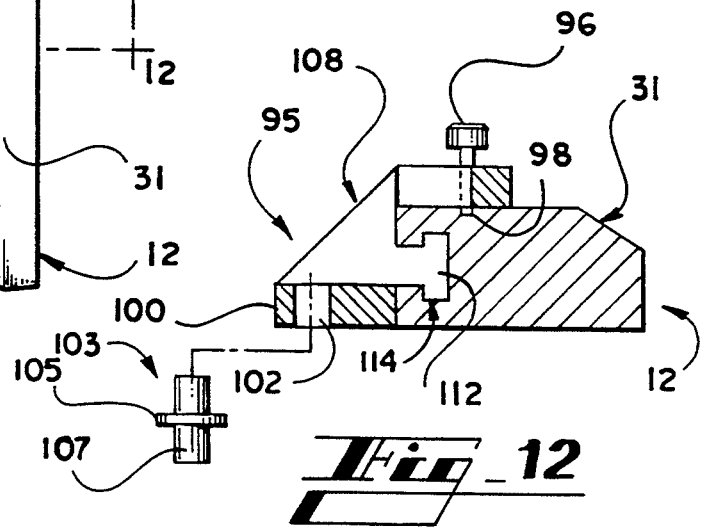
FIG. 12 is a section view of the device of FIG. 11 taken along the section lines 12—12.

Similarly, the device may be used for making cuts parallel to an edge of a material. To make these cuts, a standard knife or blade (not shown) and a knife blade guide 95 similar to that shown in FIG. 11 are used. The knife blade guide 95 is held in place relative to the elongate member 12 by a tension screw 96. The tension screw engages a notch 98 extending the length of the elongate member. The knife blade guide 95 includes a flat plate 100 in which there is a circumference marker 102, the use of which is described below. The knife blade guide 95 preferably includes two knife slots 104 and 106, each extending at a 45° angle from the elongate member 12. Sloped sides 108 and 110 extend from the knife slots 104 and 108 up to the top of the elongate member 12. The flat plate 100 is supported by two tabs 101 which extend to the sloped surfaces 108 and 110. Preferably, some type of support such as the insert 112 is made to be inserted underneath or inside of a groove 114 in the elongate member 12.

As can be seen by the construction of the knife blade guide 95, if a knife (not shown) is inserted in one of the knife slots 104 or 106, and the device is moved with one of the ledges 22 or 24 abutting the straight edge of a surface of a material, the knife will cut the surface at a line parallel to the straight edge. The two knife slots 104 and 106 are oriented such that the device may be used to cut with either ledge 22 or 24 against the straight edge. Similarly, a large carpenter's pencil can be inserted in the slots 104 or 106 to draw lines on the surface parallel to the straight edge.

Still another function of the device 10 is a circumference marker for an arc. A nail (not shown) is inserted into the pivot hole 27 and driven into the surface to be marked. Since the ledges 22 and 24 will create a gap between the elongate member 12 and the surface to be marked, a sleeve 103 for receiving a pencil is inserted into the circumference marker 102. This sleeve 103 includes a flange 105 for engaging the bottom of the flat plate 100. The bottom extension 107 of the sleeve 103 causes the knife blade guide 95 and therefore the elongate member 12 to be spaced away from the surface to be marked a distance equal to the space created by the ledges 22 and 24 between the elongate member and the surface to be marked.

Once the nail is inserted at the pivot hole 27 and the knife blade guide 95 is adjusted to the appropriate position, the circumference marker 102 is ready for use. A pencil or other writing instrument (not shown) is inserted into the sleeve 103 in the circumference marker 102 and the device is pivoted about the pivot hole 27. Thus, the pencil in the circumference marker 102 will draw an arc or a circle with a radius equal to the distance from the circumference marker 102 to the pivot surface 26. This radius will be roughly equivalent to the scale 32 on the elongate member 12. To draw even larger circles, the elongate member of the device 10 may be extended, or attachments (not shown) may be added which extend the elongate member.

Figure 10:
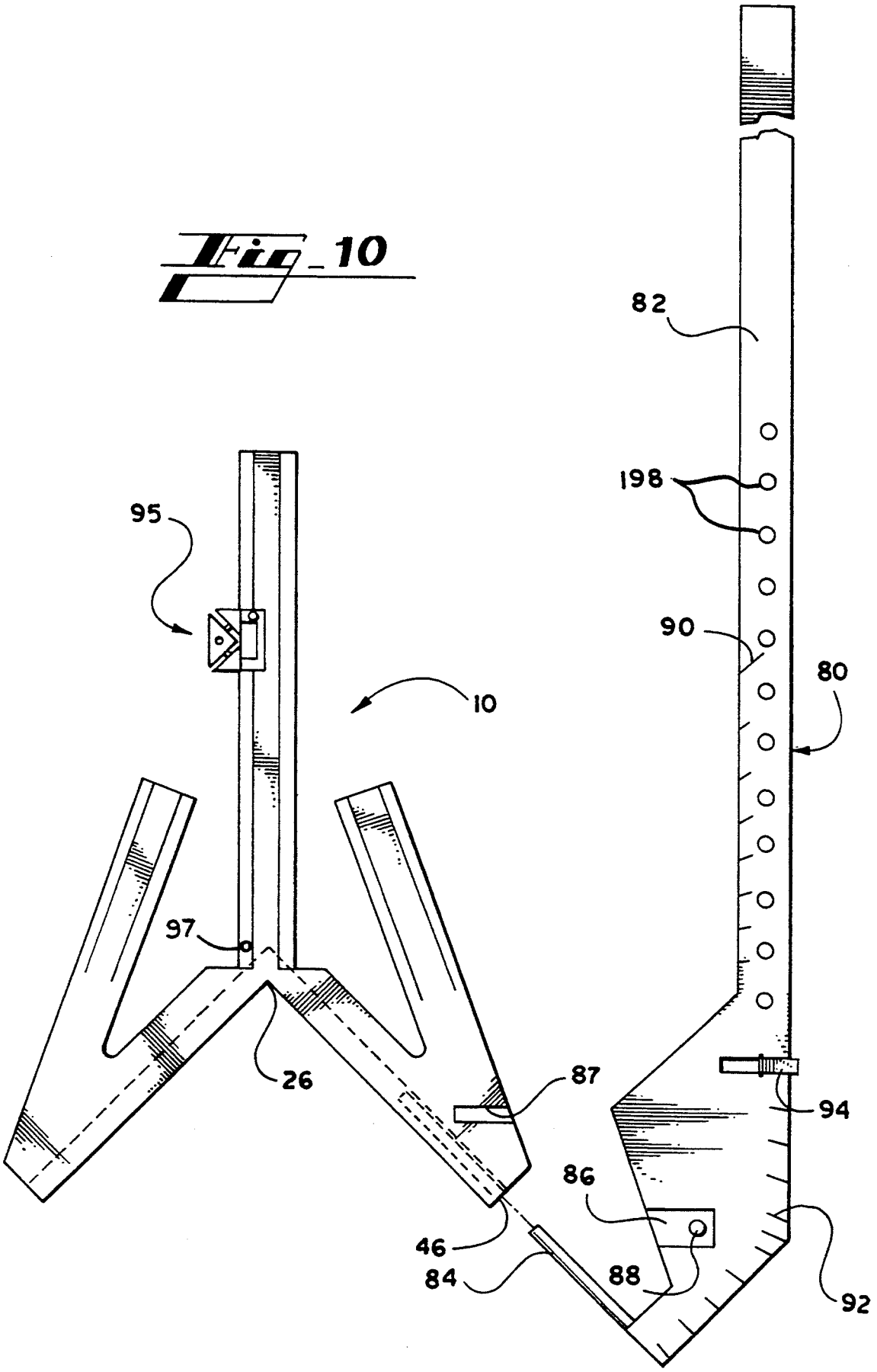
FIG. 10 is a pictorial view of an attachment for use with the device shown in FIG. 1A.

Referring now to FIG. 10, an attachment 80 may be added to the device 10 so that even more functions can be performed. The attachment 80 includes an elongate portion 82 which extends parallel to the elongate member 12 of the device 10 when the attachment is connected to the device. A rod 84 extends from the bottom of the attachment for inserting in a hole 46 in the leg 16. The attachment 80 is further held in place by a sliding lock 86 which slides over and connects to a member 87 on the device 10. The sliding lock 86 is held in place by a tension screw 88. Scales 90 and 92 are included along the length of the attachment 80 for indicating the degrees of pivot of the device and the attachment from the pivot surface 26 to the right and left, respectively. A hinged stop 94 is preferably provided on the attachment 82, the function of which will be described below. A series of holes 198 extend up the attachment 82, the function of which is described below.

The first function of the attachment 82 is the use of the scales 90 and 92 to determine the amount of pivot of the device and the attachment about the pivot surface 26. The hinged stop 94 is located at 0° on the scales such that folding the hinged stop downward and abutting the pivot surface 26 and the hinged stop 46 against a straight edge causes the elongate member 12 of the device and the elongate portion 82 of the attachment 80 to be perpendicular to the straight edge. The elongate portion 82 may also be used as a saw guide or for marking a pitch line which is longer than can be made with the elongate member 12.

Another function of the attachment 82 is to mark long-cut pitch lines. As is well known in the art of roof framing, a long-cut pitch line is located 90° from the short-cut pitch line. To mark the long-cut pitch lines with the attachment 82, a mark is made at a notch 97 on the device 10.

Another mark is then made at one of the holes 198 on the attachment corresponding to the correct pitch. The holes 198 are placed such that a line extending from the notch 97 to a hole 198 will create a proper angle with the edge of the board when the hinged stop 94 and the pivot surface 26 abut the edge of the board. The holes 198 will be located on lines which form angles corresponding to common and hip-and-valley scales, the angles of which were listed above. Although these angles may correspond to the angles for the scales 36 and 40, it can be seen that a line extending from the notch 97 to a hole on the elongate portion 82 will extend at a right angle to the line made by the elongate member 12 at the same angle. Since the elongated portion 82 may extend any length, the attachment 80 may include holes which correspond to pitch lines much higher than that included on the wings 18 and 20 on the device 10.

It can be seen from the foregoing description that a variety of different functions can be performed with the present invention. With the proper selection of materials, a lightweight, versatile, and helpful tool can be fabricated.

The foregoing description relates to preferred embodiments of the present invention, and modifications or alterations may be made without departing from the spirit and scope of the invention as defined in the following claims.

I claim:

1. A device for use in laying out pitch angles on a rafter including a straight edge thereon, said device comprising:

an elongate body member defining an axis therethrough.

a pivot surface attached along a bottom side of said body member and located on said axis;

two legs defining top sides and bottom sides thereon and extending from a juncture on said elongate body member, said legs and said elongate body member being coplanar and forming a Y configuration; and at least one wing member extending from one of said legs coplanar with said elongate body member and including a scale thereon comprising a plurality of spaced apart marks each of which corresponds to an angle;

said device being configured such that when said pivot surface is positioned adjacent said straight edge of said rafter, said scale on said wing member corresponds with said straight edge of said rafter, said angle corresponding to said one of said plurality of marks indicating the angle formed between said elongate body member and said straight edge of said rafter.

2. The device of claim 1, wherein said device comprises two wings, each extending from one of said legs, said wings located on opposite sides of the elongate body member.

3. The device of claim 1, wherein said two legs form a right angle and each leg forms a 135° angle with said elongate planar body member.

4. The device of claim 1, wherein the number of said wing members is two and said wing members extend toward the portion of said Y configuration which is formed by said elongate body member from a location on said legs which is spaced away from said juncture.

5. The device of claim 1, wherein said pivot surface is formed by two ledges extending under the bottom of said legs and along said legs, said ledges meeting at said juncture to form said pivot surface.

6. The device of claim 5, further comprising a scale extending up said elongate member such that when one of said ledges extends along the side of the straight edge and said wings and said elongate member lay against the rafter, said scale and said elongate planar body member are at a 45° to the straight edge and said scale reads a perpendicular distance from the straight edge.

7. The device of claim 1, further comprising holes extending through said elongate planar body member, said holes extending perpendicular to said axis such that said holes may receive a writing instrument for marking on the rafter.

8. The device of claim 5, further comprising a blade guide for receiving a blade and associated with said elongate member such that when said blade guide is attached to said elongate member and one of said ledges extends along the side of the straight edge and said wings and said elongate member lay against the rafter, said blade is oriented so as to cut parallel to said straight edge.

9. The device of claim 1, further comprising a scale extending the length of said elongate member corresponding to lengths from said pivot surface such that when said device is rotated about said pivot surface, a mark on said scale moves about said pivot surface on an arc with a radius corresponding to the length of said scale.

10. The device of claim 9, further comprising means for positioning a writing instrument in fixed relation to said scale.

11. The device of claim 1, wherein said pivot surface is formed by a ledge extending under the bottom of one of said legs and along said one of said legs, said ledge ending at said juncture to form said pivot surface.

12. The device of claim 11, further comprising a blade guide for receiving a blade and associated with said elongate member such that when said blade guide is attached to said elongate member and said ledge extends along said side of said straight edge and said wings and said elongate member lay flat against said rafter, said blade is oriented so as to cut parallel to said straight edge.

13. The device of claim 11, further comprising a scale extending up said elongate member such that when said ledge extends along the side of said straight edge and said wings and said elongate member lay against the rafter, said scale and said elongate planar body member are at a 45° angle to the straight edge and said scale reads a perpendicular distance from the straight edge.

14. A device for use in carpentry, said device comprising:

an elongate body member defining an axis therethrough;

a first leg and a second leg coplanar with said elongate body member and extending from a juncture on said elongate body member, said legs and said elongate member forming a Y configuration, and said legs forming a right angle;

two wing members coplanar with said elongate body member and said legs and including scales thereon, said wing members extending toward the portion of said Y configuration which is formed by said elongate body member from locations on said legs spaced away from said juncture; and a pivot surface attached along a bottom side of said elongate body member.

15. The device of claim 14, further comprising an attachment comprising:

means for fastening said attachment to one of said legs of said device; and an extended, elongate portion which, when attached to said device, extends parallel to said elongate member on said device.

16. The device of claim 15, said attachment further comprising a hinged stop pivotable to extend perpendicular to the plane of said device such that a line extending through said pivot surface and said hinged stop would extend perpendicular to said elongate portion.

17. The device of claim 14, further comprising a first ledge extending perpendicular to and along first leg and a second ledge extending perpendicular to and along said second leg, said first and second ledges forming a right angle and meeting at said juncture to form said pivot surface.

18. The device of claim 17, further comprising a knife blade guide, said knife blade guide comprising:

means for attaching said guide to said elongate member such that when one of said ledges abuts a straight edge, a knife in said guide is positioned so that it may cut parallel to said straight edge; and means for positioning a blade or knife in said guide.

19. A device for use in carpentry, said device comprising:

an elongate body member defining an axis therethrough;

a first leg and a second leg coplanar with said elongate member and extending from a juncture on said elongate member, said legs and said elongate member forming a Y configuration, and said legs forming a right angle;

a first ledge extending perpendicular to and along said first leg and a second ledge extending perpendicular to and along said second leg, said first and second ledges forming a right angle and meeting at said juncture to form a pivot surface;

a series of holes extending through said elongate body member, said holes extending perpendicular to said axis, such that said holes may receive a writing instrument for marking on a surface having a straight edge, whereby a user may abut one of said ledges along said straight edge of said surface and move said device linearly along said straight edge such that said writing instrument remains a fixed length from said straight edge on said surface;

two wing members coplanar with said elongate member and said legs, and including scales thereon, said scales comprising a plurality of spaced-apart marks each of which corresponds to an angle, said wing members extending toward the portion of said Y configuration which is formed by said elongate body member from locations on said legs spaced away from said juncture; and said device being configured such that when said pivot surface is positioned adjacent a straight edge of a board, one of said plurality of marks of one of said scales on one of said wing members corresponds with said straight edge of said board, said angle corresponding to said one of said plurality of marks indicating the angle formed between said elongate body member and said straight edge of said board.

* * * * *